US009029308B1

(12) United States Patent
Koo et al.

(10) Patent No.: US 9,029,308 B1
(45) Date of Patent: May 12, 2015

(54) LOW FOAM MEDIA CLEANING DETERGENT

(75) Inventors: Soh Kian Koo, Bayan Lepas (MY); Kok Kin Yap, Sungai Petani (MY); EE Boon Quah, Penang (MY)

(73) Assignee: WD Media, LLC, San Jose, CA (US)

( * ) Notice: Subject to any disclaimer, the term of this patent is extended or adjusted under 35 U.S.C. 154(b) by 459 days.

(21) Appl. No.: 13/433,037

(22) Filed: Mar. 28, 2012

(51) Int. Cl.
*C11D 1/72* (2006.01)
*C11D 11/00* (2006.01)

(52) U.S. Cl.
CPC ..... *C11D 11/0047* (2013.01)

(58) Field of Classification Search
CPC ..... C11D 11/0047; C11D 3/361
USPC ..... 510/175, 365, 109, 167
See application file for complete search history.

(56) References Cited

U.S. PATENT DOCUMENTS 6,013,161 A 1/2000 Chen et al.
6,063,248 A 5/2000 Bourez et al.
6,068,891 A 5/2000 O'Dell et al.
6,086,730 A 7/2000 Liu et al.
6,099,981 A 8/2000 Nishimori
6,103,404 A 8/2000 Ross et al.
6,117,499 A 9/2000 Wong et al.
6,136,403 A 10/2000 Prabhakara et al.
6,143,375 A 11/2000 Ross et al.
6,145,849 A 11/2000 Bae et al.
6,146,737 A 11/2000 Malhotra et al.
6,149,696 A 11/2000 Jia
6,150,015 A 11/2000 Bertero et al.
6,156,404 A 12/2000 Ross et al.
6,159,076 A 12/2000 Sun et al.
6,164,118 A 12/2000 Suzuki et al.
6,200,441 B1 3/2001 Gornicki et al.
6,204,995 B1 3/2001 Hokkyo et al.
6,206,765 B1 3/2001 Sanders et al.
6,210,819 B1 4/2001 Lal et al.
6,216,709 B1 4/2001 Fung et al.
6,221,119 B1 4/2001 Homola
6,248,395 B1 6/2001 Homola et al.
6,261,681 B1 7/2001 Suekane et al.
6,270,885 B1 8/2001 Hokkyo et al.
6,274,063 B1 8/2001 Li et al.
6,283,838 B1 9/2001 Blake et al.
6,287,429 B1 9/2001 Moroishi et al.
6,290,573 B1 9/2001 Suzuki
6,299,947 B1 10/2001 Suzuki et al.
6,303,217 B1 10/2001 Malhotra et al.
6,309,765 B1 10/2001 Suekane et al.
6,358,636 B1 3/2002 Yang et al.
6,362,452 B1 3/2002 Suzuki et al.
6,363,599 B1 4/2002 Bajorek
6,365,012 B1 4/2002 Sato et al.
6,381,090 B1 4/2002 Suzuki et al.
6,381,092 B1 4/2002 Suzuki
6,387,483 B1 5/2002 Hokkyo et al.
6,391,213 B1 5/2002 Homola
6,395,349 B1 5/2002 Salamon (Continued)

OTHER PUBLICATIONS

EE Boon Quah, et al., U.S. Appl. No. 12/841,121, filed Jul. 21, 2010, 16 pages.

*Primary Examiner* — Gregory Webb

(57) ABSTRACT

A chemical composition for cleaning a medium is provided. For some embodiments, the chemical composition comprises a nonionic surfactant, an inorganic salt, a glycol compound, a chelating agent, and deionized water. For example, the chemical composition may comprise between about 1% and 5% of nonionic surfactant, between about 2% and 6% by weight of an inorganic salt, between about 5% and 10% by weight of a glycol compound, between about 5% and 10% by weight of a chelating agent, and deionized water.

10 Claims, 3 Drawing Sheets

(56) References Cited

U.S. PATENT DOCUMENTS 6,403,919 B1 6/2002 Salamon
6,408,677 B1 6/2002 Suzuki
6,426,157 B1 7/2002 Hokkyo et al.
6,429,984 B1 8/2002 Alex
6,482,330 B1 11/2002 Bajorek
6,482,505 B1 11/2002 Bertero et al.
6,500,567 B1 12/2002 Bertero et al.
6,506,261 B1 * 1/2003 Man ..... 134/39
6,514,862 B2 2/2003 Lee et al.
6,528,124 B1 3/2003 Nguyen
6,548,821 B1 4/2003 Treves et al.
6,552,871 B2 4/2003 Suzuki et al.
6,565,719 B1 5/2003 Lairson et al.
6,566,674 B1 5/2003 Treves et al.
6,571,806 B2 6/2003 Rosano et al.
6,628,466 B2 9/2003 Alex
6,664,503 B1 12/2003 Hsieh et al.
6,670,055 B2 12/2003 Tomiyasu et al.
6,682,807 B2 1/2004 Lairson et al.
6,683,754 B2 1/2004 Suzuki et al.
6,730,420 B1 5/2004 Bertero et al.
6,743,528 B2 6/2004 Suekane et al.
6,759,138 B2 7/2004 Tomiyasu et al.
6,778,353 B1 8/2004 Harper
6,795,274 B1 9/2004 Hsieh et al.
6,855,232 B2 2/2005 Jairson et al.
6,857,937 B2 2/2005 Bajorek
6,893,748 B2 5/2005 Bertero et al.
6,899,959 B2 5/2005 Bertero et al.
6,916,558 B2 7/2005 Umezawa et al.
6,939,120 B1 9/2005 Harper
6,946,191 B2 9/2005 Morikawa et al.
6,967,798 B2 11/2005 Homola et al.
6,972,135 B2 12/2005 Homola
7,004,827 B1 2/2006 Suzuki et al.
7,006,323 B1 2/2006 Suzuki
7,016,154 B2 3/2006 Nishihira
7,019,924 B2 3/2006 McNeil et al.
7,045,215 B2 5/2006 Shimokawa
7,056,829 B2 6/2006 Bian et al.
7,070,870 B2 7/2006 Bertero et al.
7,090,934 B2 8/2006 Hokkyo et al.
7,099,112 B1 8/2006 Harper
7,105,241 B2 9/2006 Shimokawa et al.
7,119,990 B2 10/2006 Bajorek et al.
7,147,790 B2 12/2006 Wachenschwanz et al.
7,161,753 B2 1/2007 Wachenschwanz et al.
7,166,319 B2 1/2007 Ishiyama
7,166,374 B2 1/2007 Suekane et al.
7,169,487 B2 1/2007 Kawai et al.
7,174,775 B2 2/2007 Ishiyama
7,179,549 B2 2/2007 Malhotra et al.
7,184,139 B2 2/2007 Treves et al.
7,196,860 B2 3/2007 Alex
7,199,977 B2 4/2007 Suzuki et al.
7,208,236 B2 4/2007 Morikawa et al.
7,220,500 B1 5/2007 Tomiyasu et al.
7,229,266 B2 6/2007 Harper
7,239,970 B2 7/2007 Treves et al.
7,252,897 B2 8/2007 Shimokawa et al.
7,277,254 B2 10/2007 Shimokawa et al.
7,281,920 B2 10/2007 Homola et al.
7,292,329 B2 11/2007 Treves et al.
7,301,726 B1 11/2007 Suzuki
7,302,148 B2 11/2007 Treves et al.
7,305,119 B2 12/2007 Treves et al.
7,314,404 B2 1/2008 Singh et al.
7,320,584 B1 1/2008 Harper et al.
7,329,114 B2 2/2008 Harper et al.
7,375,362 B2 5/2008 Treves et al.
7,416,680 B2 8/2008 Benning et al.
7,420,886 B2 9/2008 Tomiyasu et al.
7,425,719 B2 9/2008 Treves et al.
7,471,484 B2 12/2008 Wachenschwanz et al.
7,498,062 B2 3/2009 Calcaterra et al.
7,531,485 B2 5/2009 Hara et al.
7,537,846 B2 5/2009 Ishiyama et al.
7,549,209 B2 6/2009 Wachenschwanz et al.
7,569,490 B2 8/2009 Staud
7,597,792 B2 10/2009 Homola et al.
7,597,973 B2 10/2009 Ishiyama
7,608,193 B2 10/2009 Wachenschwanz et al.
7,632,087 B2 12/2009 Homola
7,656,615 B2 2/2010 Wachenschwanz et al.
7,682,546 B2 3/2010 Harper
7,684,152 B2 3/2010 Suzuki et al.
7,686,606 B2 3/2010 Harper et al.
7,686,991 B2 3/2010 Harper
7,695,833 B2 4/2010 Ishiyama
7,722,968 B2 5/2010 Ishiyama
7,733,605 B2 6/2010 Suzuki et al.
7,736,768 B2 6/2010 Ishiyama
7,755,861 B1 7/2010 Li et al.
7,758,732 B1 7/2010 Calcaterra et al.
7,790,618 B2 9/2010 Bian
7,833,639 B2 11/2010 Sonobe et al.
7,833,641 B2 11/2010 Tomiyasu et al.
7,842,192 B2 11/2010 Bian et al.
7,910,159 B2 3/2011 Jung
7,911,736 B2 3/2011 Bajorek
7,918,941 B2 * 4/2011 Tamura et al. ..... 134/1.3
7,924,519 B2 4/2011 Lambert
7,944,165 B1 5/2011 O'Dell
7,944,643 B1 5/2011 Jiang et al.
7,955,723 B2 6/2011 Umezawa et al.
7,983,003 B2 7/2011 Sonobe et al.
7,993,497 B2 8/2011 Moroishi et al.
7,993,765 B2 8/2011 Kim et al.
7,998,912 B2 8/2011 Chen et al.
8,002,901 B1 8/2011 Chen et al.
8,003,237 B2 8/2011 Sonobe et al.
8,012,920 B2 9/2011 Shimokawa
8,025,809 B2 9/2011 Andreas
8,038,863 B2 10/2011 Homola
8,057,926 B2 11/2011 Ayama et al.
8,062,778 B2 11/2011 Suzuki et al.
8,064,156 B1 11/2011 Suzuki et al.
8,076,013 B2 12/2011 Sonobe et al.
8,092,931 B2 1/2012 Ishiyama et al.
8,100,685 B1 1/2012 Harper et al.
8,101,054 B2 1/2012 Chen et al.
8,125,723 B1 2/2012 Nichols et al.
8,125,724 B1 2/2012 Nichols et al.
8,137,517 B1 3/2012 Bourez
8,142,916 B2 3/2012 Umezawa et al.
8,163,093 B1 4/2012 Chen et al.
8,171,949 B1 5/2012 Lund et al.
8,173,282 B1 5/2012 Sun et al.
8,178,480 B2 5/2012 Hamakubo et al.
8,206,789 B2 6/2012 Suzuki
8,218,260 B2 7/2012 Iamratanakul et al.
8,247,095 B2 8/2012 Champion et al.
8,257,783 B2 9/2012 Suzuki et al.
8,298,609 B1 10/2012 Liew et al.
8,298,689 B2 10/2012 Sonobe et al.
8,309,239 B2 11/2012 Umezawa et al.
8,314,028 B2 11/2012 Hong et al.
8,316,668 B1 11/2012 Chan et al.
8,331,056 B2 12/2012 O'Dell
8,354,618 B1 1/2013 Chen et al.
8,367,228 B2 2/2013 Sonobe et al.
8,383,209 B2 2/2013 Ayama
8,394,243 B1 3/2013 Jung et al.
8,397,751 B1 3/2013 Chan et al.
8,399,809 B1 3/2013 Bourez
8,402,638 B1 3/2013 Treves et al.
8,404,056 B1 3/2013 Chen et al.
8,404,369 B2 3/2013 Ruffini et al.
8,404,370 B2 3/2013 Sato et al.
8,406,918 B2 3/2013 Tan et al.
8,414,966 B2 4/2013 Yasumori et al.
8,425,975 B2 4/2013 Ishiyama
8,431,257 B2 4/2013 Kim et al.
8,431,258 B2 4/2013 Onoue et al.

(56) References Cited

U.S. PATENT DOCUMENTS 8,453,315 B2 6/2013 Kajiwara et al.
8,488,276 B1 7/2013 Jung et al.
8,491,800 B1 7/2013 Dorsey
8,492,009 B1 7/2013 Homola et al.
8,492,011 B2 7/2013 Itoh et al.
8,496,466 B1 7/2013 Treves et al.
8,517,364 B1 8/2013 Crumley et al.
8,517,657 B2 8/2013 Chen et al.
8,524,052 B1 9/2013 Tan et al.
8,530,065 B1 9/2013 Chernyshov et al.
8,546,000 B2 10/2013 Umezawa
8,551,253 B2 10/2013 Na'im et al.
8,551,627 B2 10/2013 Shimada et al.
8,556,566 B1 10/2013 Suzuki et al.
8,559,131 B2 10/2013 Masuda et al.
8,562,748 B1 10/2013 Chen et al.
8,565,050 B1 10/2013 Bertero et al.
8,570,844 B1 10/2013 Yuan et al.
8,580,410 B2 11/2013 Onoue
8,584,687 B1 11/2013 Chen et al.
8,591,709 B1 11/2013 Lim et al.
8,592,061 B2 11/2013 Onoue et al.
8,596,287 B1 12/2013 Chen et al.
8,597,723 B1 12/2013 Jung et al.
8,603,649 B2 12/2013 Onoue
8,603,650 B2 12/2013 Sonobe et al.
8,605,388 B2 12/2013 Yasumori et al.
8,605,555 B1 12/2013 Chernyshov et al.
8,608,147 B1 12/2013 Yap et al.
8,609,263 B1 12/2013 Chernyshov et al.
8,619,381 B2 12/2013 Moser et al.
8,623,528 B2 1/2014 Umezawa et al.
8,623,529 B2 1/2014 Suzuki
8,634,155 B2 1/2014 Yasumori et al.
8,658,003 B1 2/2014 Bourez
8,658,292 B1 2/2014 Mallary et al.
8,665,541 B2 3/2014 Saito
8,668,953 B1 3/2014 Buechel-Rimmel
8,674,327 B1 3/2014 Poon et al.
8,685,214 B1 4/2014 Moh et al.
8,696,404 B2 4/2014 Sun et al.
8,711,499 B1 4/2014 Desai et al.
8,743,666 B1 6/2014 Bertero et al.
8,758,912 B2 6/2014 Srinivasan et al.
8,787,124 B1 7/2014 Chernyshov et al.
8,787,130 B1 7/2014 Yuan et al.
8,791,391 B2 7/2014 Bourez
8,795,765 B2 8/2014 Koike et al.
8,795,790 B2 8/2014 Sonobe et al.
8,795,857 B2 8/2014 Ayama et al.
8,800,322 B1 8/2014 Chan et al.
8,811,129 B1 8/2014 Yuan et al.
8,817,410 B1 8/2014 Moser et al.
2002/0060883 A1 5/2002 Suzuki
2003/0022024 A1 1/2003 Wachenschwanz
2003/0144163 A1 7/2003 Morinaga et al.
2004/0022387 A1 2/2004 Weikle
2004/0132301 A1 7/2004 Harper et al.
2004/0202793 A1 10/2004 Harper et al.
2004/0202865 A1 10/2004 Homola et al.
2004/0209123 A1 10/2004 Bajorek et al.
2004/0209470 A1 10/2004 Bajorek
2005/0036223 A1 2/2005 Wachenschwanz et al.
2005/0109980 A1 5/2005 Wang
2005/0142990 A1 6/2005 Homola
2005/0150862 A1 7/2005 Harper et al.
2005/0151282 A1 7/2005 Harper et al.
2005/0151283 A1 7/2005 Bajorek et al.
2005/0151300 A1 7/2005 Harper et al.
2005/0155554 A1 7/2005 Saito
2005/0167867 A1 8/2005 Bajorek et al.
2005/0199272 A1* 9/2005 Levitt et al. ..... 134/26
2005/0263401 A1 12/2005 Olsen et al.
2006/0147758 A1 7/2006 Jung et al.
2006/0181697 A1 8/2006 Treves et al.
2006/0207890 A1 9/2006 Staud
2007/0070549 A1 3/2007 Suzuki et al.
2007/0245909 A1 10/2007 Homola
2008/0075845 A1 3/2008 Sonobe et al.
2008/0090500 A1 4/2008 Hellring et al.
2008/0093760 A1 4/2008 Harper et al.
2009/0031636 A1 2/2009 Ye et al.
2009/0104851 A1 4/2009 Cherian et al.
2009/0117408 A1 5/2009 Umezawa et al.
2009/0136784 A1 5/2009 Suzuki et al.
2009/0149364 A1 6/2009 Beck
2009/0169922 A1 7/2009 Ishiyama
2009/0191331 A1 7/2009 Umezawa et al.
2009/0202816 A1 8/2009 Schlenoff
2009/0202866 A1 8/2009 Kim et al.
2009/0311557 A1 12/2009 Onoue et al.
2009/0312219 A1 12/2009 Tamura et al.
2010/0143752 A1 6/2010 Ishibashi et al.
2010/0190035 A1 7/2010 Sonobe et al.
2010/0196619 A1 8/2010 Ishiyama
2010/0196740 A1 8/2010 Ayama et al.
2010/0209601 A1 8/2010 Shimokawa et al.
2010/0215992 A1 8/2010 Horikawa et al.
2010/0232065 A1 9/2010 Suzuki et al.
2010/0247965 A1 9/2010 Onoue
2010/0261039 A1 10/2010 Itoh et al.
2010/0279151 A1 11/2010 Sakamoto et al.
2010/0300884 A1 12/2010 Homola et al.
2010/0304186 A1 12/2010 Shimokawa
2011/0097603 A1 4/2011 Onoue
2011/0097604 A1 4/2011 Onoue
2011/0171495 A1 7/2011 Tachibana et al.
2011/0206947 A1 8/2011 Tachibana et al.
2011/0212346 A1 9/2011 Onoue et al.
2011/0223446 A1 9/2011 Onoue et al.
2011/0244119 A1 10/2011 Umezawa et al.
2011/0245127 A1* 10/2011 Suzuki et al. ..... 510/163
2011/0299194 A1 12/2011 Aniya et al.
2011/0311841 A1 12/2011 Saito et al.
2011/0318928 A1 12/2011 Bian
2012/0069466 A1 3/2012 Okamoto et al.
2012/0070692 A1 3/2012 Sato et al.
2012/0077060 A1 3/2012 Ozawa
2012/0127599 A1 5/2012 Shimokawa et al.
2012/0127601 A1 5/2012 Suzuki et al.
2012/0129009 A1 5/2012 Sato et al.
2012/0140359 A1 6/2012 Tachibana
2012/0141833 A1 6/2012 Umezawa et al.
2012/0141835 A1 6/2012 Sakamoto
2012/0148875 A1 6/2012 Hamakubo et al.
2012/0156523 A1 6/2012 Seki et al.
2012/0164488 A1 6/2012 Shin et al.
2012/0170152 A1 7/2012 Sonobe et al.
2012/0171369 A1 7/2012 Koike et al.
2012/0175243 A1 7/2012 Fukuura et al.
2012/0189872 A1 7/2012 Umezawa et al.
2012/0196049 A1 8/2012 Azuma et al.
2012/0207919 A1 8/2012 Sakamoto et al.
2012/0225217 A1 9/2012 Itoh et al.
2012/0251842 A1 10/2012 Yuan et al.
2012/0251846 A1 10/2012 Desai et al.
2012/0276417 A1 11/2012 Shimokawa et al.
2012/0308722 A1 12/2012 Suzuki et al.
2013/0040167 A1 2/2013 Alagarsamy et al.
2013/0071694 A1 3/2013 Srinivasan et al.
2013/0165029 A1 6/2013 Sun et al.
2013/0175252 A1 7/2013 Bourez
2013/0216865 A1 8/2013 Yasumori et al.
2013/0230647 A1 9/2013 Onoue et al.
2013/0314815 A1 11/2013 Yuan et al.
2014/0011054 A1 1/2014 Suzuki
2014/0044992 A1 2/2014 Onoue
2014/0050843 A1 2/2014 Yi et al.
2014/0151360 A1 6/2014 Gregory et al.
2014/0234666 A1 8/2014 Knigge et al.

* cited by examiner

LOW FOAM MEDIA CLEANING DETERGENT

TECHNICAL FIELD

Invention(s) described herein relate to cleaning processes and detergents used in cleaning media and, more particularly, processes and detergents used during the manufacturing of hard drive media.

BACKGROUND

Disk media used in hard drives may include a substrate that is plated with a material such as nickel or cobalt. Subsequent to plating, a disk medium is usually polished using chemical mechanical polishing process, which exposes the surface of the disk medium to a number of different contaminants. The containments may be the result of the polish slurry, polish residue, media manufacturing equipment, or the media manufacturing environment. For instance, polishing slurry has a tendency to bond to the surface of disk media making contamination particles from the slurry difficult to remove. If contamination particles are not removed from the surface of a plated and polished disk medium, the operation and performance of a hard drive incorporating the disk medium may be negatively impacted.

Accordingly, disk manufacturers regularly utilize detergents and cleaning processes to remove contaminants from the surface of disk media before proceeding with subsequent manufacturing processes (e.g., sputter process). Unfortunately, use of certain cleaning processes and detergents are known to leave behind blisters and water stains on the surface of disk media. These blisters and water stains can result in major glide loss over the surface of a disk medium.

BRIEF DESCRIPTION OF THE DRAWINGS

The present invention is illustrated by way of example, and not limitation, in the figures of the accompanying drawings. With respect to the figures.

DETAILED DESCRIPTION

Figure 1:
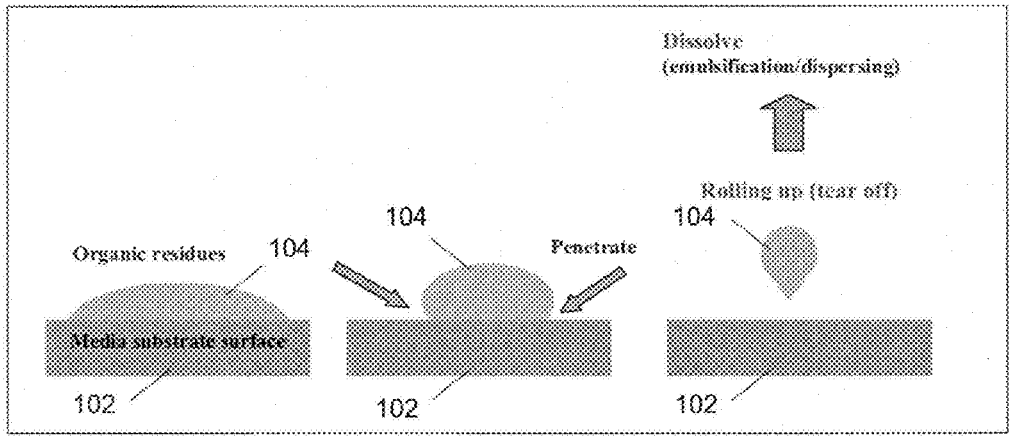
FIG. 1 illustrates the removal of organic residue from a surface of a disk medium in accordance with some embodiments of the present invention.

In the following description, numerous specific details are set forth to provide a thorough understanding of various embodiments of the present invention. It will be apparent however, to one skilled in the art that these specific details need not be employed to practice various embodiments of the present invention. In some instances, well known components or methods have not been described in detail to avoid unnecessarily obscuring various embodiments of the present invention.

Various embodiments of the present invention provide for a chemical composition, or use of the chemical composition, for cleaning a medium, such as disk media used in hard drives. In certain instances, the chemical composition may be utilized as a post-polish detergent in cleaning processes performed on disk media during their manufacturing.

For example, a post-polishing cleaning process using the chemical composition may take place after a disk medium has been plated and polished (where the polishing process provides the disk medium with an even, uniform surface). The plated disk media to be cleansed with the chemical composition may be polished using chemical mechanical polishing, which can introduce a number of contaminants to the disk medium surface (e.g., from polishing slurry, polish residue, or exposure to the manufacturing environment and machinery). During a cleaning process, the chemical composition may remove, for example, polishing slurry residues that have dried out on media substrate surfaces (e.g., containing aluminum oxide, colloidal silica or organic coolant). In various embodiments, the chemical composition employs surfactants to remove contaminants from the disk medium surface and enhance an automatic cleaning machines performance (e.g., cleaning machines by Speedfam Clean System Co., Ltd. used in disk media cleaning).

For some embodiments, the chemical composition comprises a nonionic surfactant, an inorganic salt, a glycol compound, a chelating agent, and deionized water. In particular instances, the chemical composition may comprise between about 1% and 5% of nonionic surfactant, between about 2% and 6% by weight of an inorganic salt, between about 5% and 10% by weight of a glycol compound, between about 5% and 10% by weight of a chelating agent, and deionized water. Depending on the embodiment, the nonionic surfactant may comprise polyoxyethylene arylether and polyoxyethylene phenyl, the inorganic salt may comprise potassium hydroxide, and the glycol compound may comprise dipropylene glycol methyl ether (HEDP). The medium may be a metal comprising Ni or W.

According to various embodiments, the chemical composition may assist in reducing circular blister and water stains caused that may be left after a cleaning process. This reduction may increase the quality of disk media produced during a disk media manufacturing process. The chemical composition may have a low foam property. With a low foam property for the chemical composition may determine the degree of bubbles trapped in a cleaning tank after a disk medium cleaning process. Generally, bubbles limit the flow of particles in and out of a cleaning tank (e.g., moving from the overflow out, to the inner tank, and to the drain path or from the overflow tank return, to the circulation and filtration loop). Bubbles can also remain on a (disk medium) carrier, and carry forward as a disk medium is transferred to a subsequent cleaning operation (eventually resulting in circular type of blister defect).

Furthermore, the chemical composition may be free from an amine compound, may have a low ionic/corrosion level, and may have thermal stability. For example, in dilute conditions, the chemical composition may have a cloud point above 90° C. temperature that is cleaner than other chemical compositions used as detergents.

In addition, in comparison to other chemical compositions used in cleaning disk media, the chemical composition in accordance with some embodiments may be safer for human health, may be safer for the environment, may exhibit better cleaning performance (e.g., with respect to colloidal silica slurry removal), may exhibit better chemical rinse ability. In another example, any chemical residue left by the chemical composition may be easily rinsed away from the disk medium media by a rinsing process using deionized (DI) water.

As described herein, for some embodiments, the chemical composition may be utilized in a method for cleaning a disk medium, comprising ultrasonically cleaning the medium using the chemical composition, and mechanically scrubbing the medium using the chemical composition. The method for cleaning the disk medium may further comprise rinsing the medium using deionized water. Depending on the embodiment, the method may be performed before a sputtering process is performed on the disk medium.

FIG. 1 illustrates the removal of organic residue 104 from a surface of a disk medium 102 in accordance with some embodiments of the present invention. When surface of the disk medium 102 is soaked in the chemical composition of some embodiments, the organic residue 104 can be loosened easily. The hydrophobic tail of the nonionic surfactant may attach the organic residue 104 and, at the same time, the opposite force of the hydrophilic head of the surfactant will pull organic residue 104 away from the surface of the disk medium 102. Once residue 104 has been removed, micelles in the chemical composition of some embodiments will keep organic residue 104 emulsified, suspended and dispersed so it does not redeposit back onto the surface of the disk medium 102 again.

Figure 2:
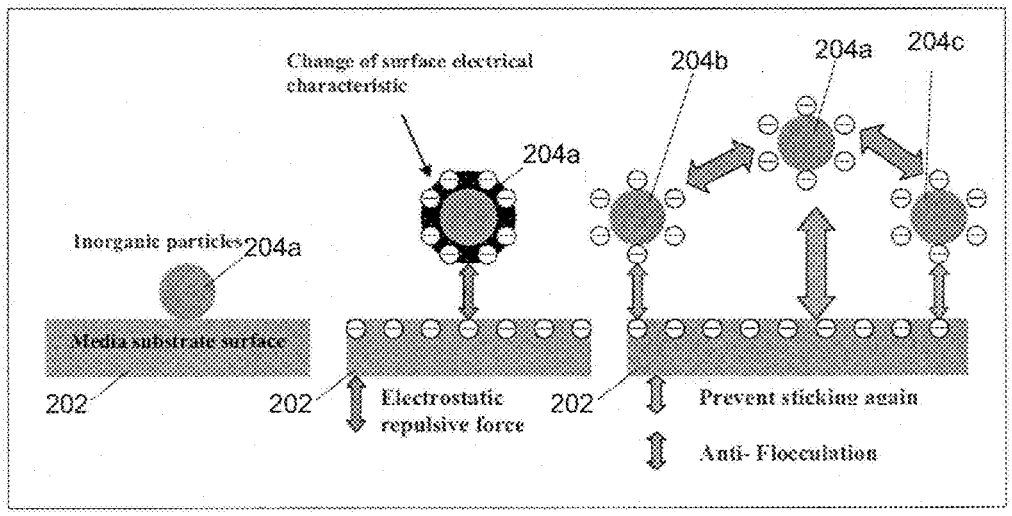
FIG. 2 illustrates the removal of inorganic particles from, a media substrate surface in accordance with some embodiments of the present invention.

FIG. 2 illustrates the removal of inorganic particles 204*a*, 204*b*, and 204*c* from a surface of the disk medium 202 in accordance with some embodiments of the present invention. In order to remove inorganic particles, such as the alumina and silica generally used in and left behind by a polishing slurry, the chemical composition of some embodiments changes the surface electrical charges so that inorganic particles 204*a*, 204*b*, and 204*c* are repelled both from the surface of the disk medium 202 and from each other.

Figure 3:
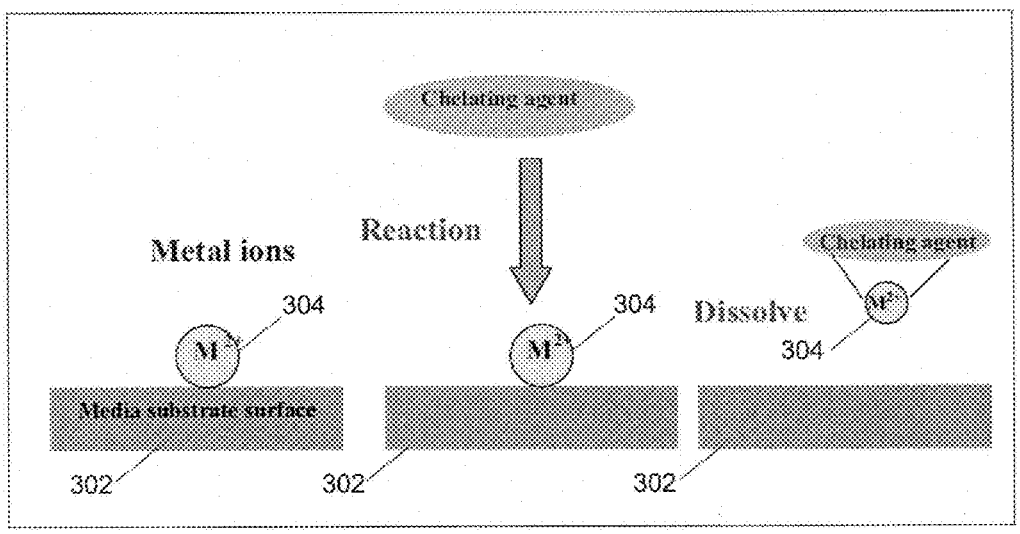
FIG. 3 illustrates the removal of a metal ion from a media substrate surface in accordance with some embodiments of the present invention.

FIG. 3 illustrates the removal of a metal ion 304 from a surface of a disk medium 302 in accordance with some embodiments of the present invention. In order to remove metal ions, the chemical composition of some embodiments may include a chelating agent. In one example, the chelating agent may comprise hydroxyethylene disphosphonic acid (HEDP) to assist in the removal of many different metal ions, such as $Ca^{2+}$, $Cu^{2+}$, $Fe^{2+}$, $Zn^{2+}$, $Fe^{3+}$, and $Ni^{2+}$, with which HEDP can form a six-member ring chelate. Typically, HEDP exhibits good chemical stability under high pH values, and is resistant to being hydrolyzed, due to HEDP's structure including all C—P bonds. In some embodiments, the chelating agent may be any that utilizes all C—P bonds.

To further assist in the removal of inorganic particles, the chemical composition of some embodiments may comprise an inorganic salt operative in controlling the pH. Examples of inorganic salt in the chemical composition may include, without limitation, potassium hydroxide. The potassium hydroxide may establish a pH of between about 12.0 and 12.5, in order to create an etching effect on the disk medium surface to be cleaned. In addition to creating the etching effect, maintaining a pH between 12.0 and 12.5 by using potassium hydroxide may allow the chemical composition to maintain a repulsive force between the disk medium surface and common inorganic contaminants, such as those listed below in Table 1 with their corresponding iso-electrical point (IEP) value.

TABLE 1

| Inorganic particle | Iso-Electrical Point (IEP) value |
|---|---|
| $SiO_2$ (silica) | 1.7-3.5 |
| $Fe_3O_4$ (magnetite) | 6.5-6.8 |
| $CeO_2$ (ceria) | 6.7-8.6 |
| $Al_2O_3$ (gamma alumina) | 7-8 |
| $Fe_2O_3$ (hematite) | 8.4-8.5 |
| $Al_2O_3$ (alpha alumina, corundum) | 8-9 |
| NiO | 10-11 |

In view of the Table 1, to create a repulsive force (i.e., a negative charge) for the listed media contaminants, the pH of the chemical composition for some embodiments may be set above 11. Because excessively high pH values may cause the chemical composition instability and chemical compatibility issues, in some embodiments, the chemical composition may comprise an inorganic salt to have a pH value of about 12.1.

Figure 4:
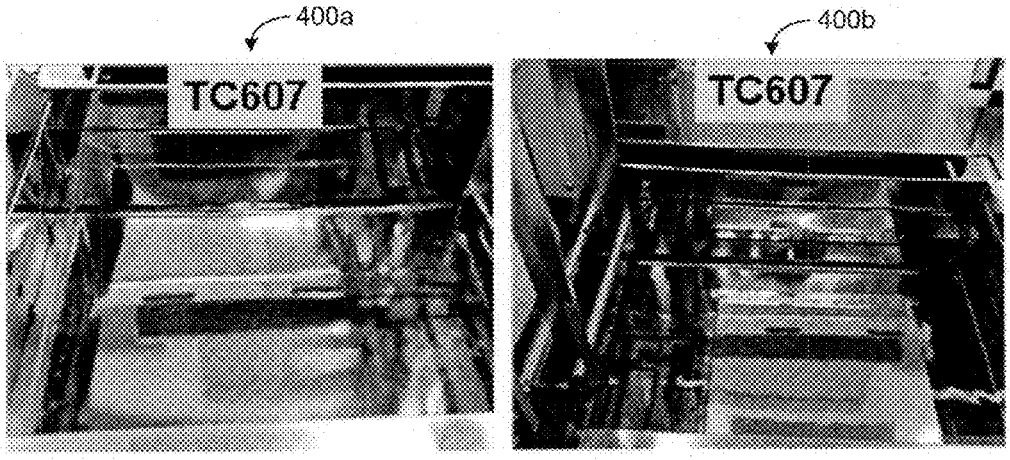
FIG. 4 provides images of a cleaning tank after use of an exemplary chemical composition in accordance with some embodiments of the present invention.

FIG. 4 provides images 400*a* and 400*b* of a cleaning tank after use of an exemplary chemical composition in accordance with some embodiments of the present invention. In addition to exhibiting great cleaning performance, the chemical composition of some embodiments enjoy improved rinsability.

To increase the chemical thermal stability of the chemical composition of some embodiments, nonionic surfactants with high ethoxylation (EO) levels in the chemical composition may increase the cloud point of the chemical composition to more than 90° C. when in a dilute condition. For some embodiments, the high cloud point in the chemical composition may be desirable as the tank water temperature for cleaning application can go as high as 60° C. The nonionic surfactant of the chemical composition may have a high EO level, such as, for example, between about 5 and about 20, to assist in preventing cloud formation in these conditions.

Figure 5:
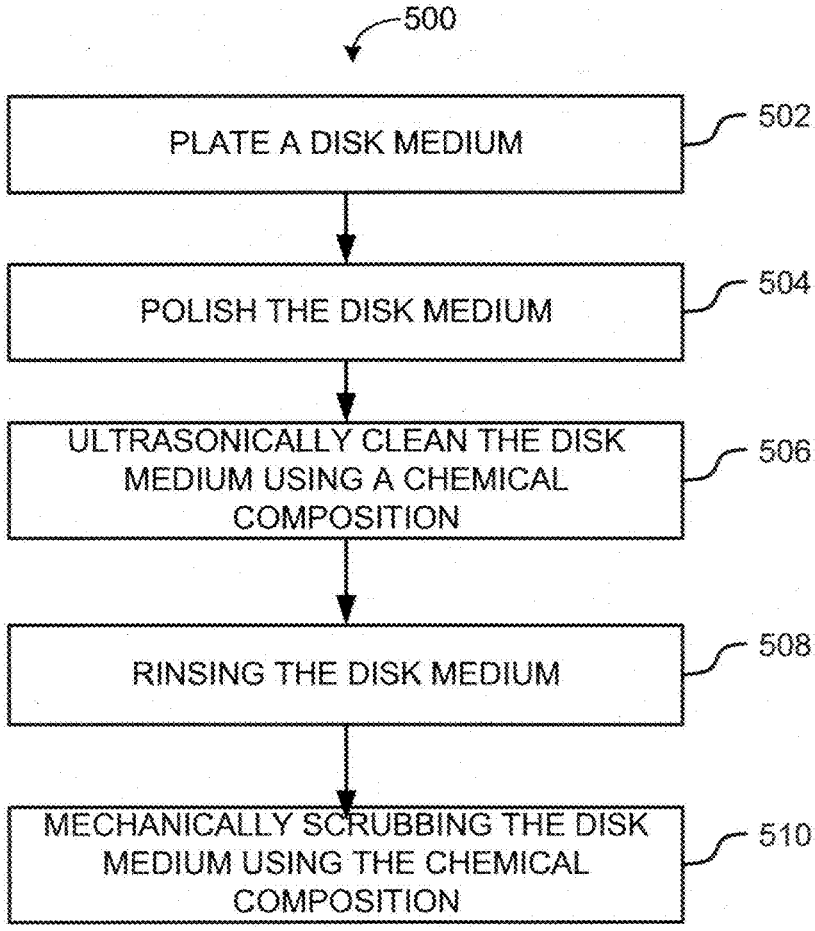
FIG. 5 is a flowchart illustrating an exemplary method for manufacturing and cleaning a disk medium in accordance with some embodiments of the present invention.

FIG. 5 is a flowchart illustrating an exemplary method 500 for manufacturing and cleaning a disk medium in accordance with some embodiments of the present invention. The method 500 may begin at operation 502, with the plating of a disk medium utilized in a hard drive. After polishing the plated disk medium at operation 504, the plated disk medium may be ultrasonically cleaned using a chemical composition as described herein at operation 506. The plated disk medium may be subsequently rinsed by deionized (DI) water at operation 508 and then mechanically scrubbed using the chemical composition at operation 510.

In the foregoing specification, embodiments of the invention have been described with reference to specific exemplary features thereof. It will, however, be evident that various modifications and changes may be made thereto without departing from the broader spirit and scope of the invention as set forth in the appended claims. The specification and figures are, accordingly, to be regarded in an illustrative rather than a restrictive sense. As such, though various embodiments disclosed herein are described with respect to a disk medium for hard drives, those skilled in the art will appreciate that various embodiments may be utilized with other types of media, which may or may not relate to hard drives.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

What is claimed is:

1. A chemical composition for cleaning a medium, the chemical composition comprising:

a nonionic surfactant having an ethoxylation level between about 5 to 20, wherein the nonionic surfactant comprises polyoxyethylene arylether and polyoxyethylene phenyl ether;

a medium etching component comprising an inorganic salt, the inorganic salt creating a pH of the chemical composition that is between about 12.0 to 12.5 at a temperature up to about 60 degrees Celsius;

a glycol compound;

a chelating agent; and deionized water.

2. The chemical composition of claim 1, wherein the polyoxyethylene arylether is about 1 to 5 wt. % of the chemical composition.

3. The chemical composition of claim 1, wherein the polyoxyethylene phenyl ether is 1 to 5 wt. % of the chemical composition.

4. The chemical composition of claim 1, wherein the inorganic salt comprises potassium hydroxide.

5. The chemical composition of claim 4, wherein the potassium hydroxide is about 2 to 6 wt. % of the chemical composition.

6. The chemical composition of claim 1, wherein the glycol compound comprises dipropylene glycol methyl ether.

7. The chemical composition of claim 6, wherein the dipropylene glycol methyl ether is about 5 to 10 wt. % of the chemical composition.

8. The chemical composition of claim 1, wherein the chelating agent comprises hydroxyethylene disphosphonic acid (HEDP).

9. The chemical composition of claim 8, wherein the hydroxyethylene disphosphonic acid (HEDP) is about 5 to 10 wt. % of the chemical composition.

10. The chemical composition of claim 1, wherein the medium is a magnetic medium.

* * * * *